US011092047B2

(12) United States Patent
Schmitt et al.

(10) Patent No.: US 11,092,047 B2
(45) Date of Patent: Aug. 17, 2021

(54) OIL SUPPLY UNIT AND MOTOR VEHICLE

(71) Applicant: Ford Global Technologies, LLC, Dearborn, MI (US)

(72) Inventors: Andreas Schmitt, Aachen (DE); Hans Guenter Quix, Herzogenrath (DE); David van Bebber, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 834 days.

(21) Appl. No.: 15/716,182

(22) Filed: Sep. 26, 2017

(65) Prior Publication Data

US 2018/0087415 A1 Mar. 29, 2018

(30) Foreign Application Priority Data

Sep. 29, 2016 (DE) ..... 102016218835.6

(51) Int. Cl.

| | |
|---|---|
| ***F01M 5/02*** | (2006.01) |
| ***F01M 11/02*** | (2006.01) |
| ***F01M 1/02*** | (2006.01) |
| ***F01M 1/16*** | (2006.01) |
| ***F01M 11/00*** | (2006.01) |

(52) U.S. Cl.

CPC ..... *F01M 5/025* (2013.01); *F01M 1/02* (2013.01); *F01M 1/16* (2013.01); *F01M 11/0004* (2013.01); *F01M 11/02* (2013.01); *F01M 5/02* (2013.01); *F01M 5/021* (2013.01); *F01M 2001/0253* (2013.01); *F01M 2005/028* (2013.01)

(58) Field of Classification Search

CPC ..... F01M 5/025; F01M 2005/026; F01M 2005/028

See application file for complete search history.

(56) References Cited

U.S. PATENT DOCUMENTS

| | | | | | |
|---|---|---|---|---|---|
| 1,872,279 | A * | 8/1932 | Hallett | F01M 5/025 | 184/6.3 |
| 2,736,307 | A * | 2/1956 | Wilcox | F01M 5/025 | 123/196 S |
| 2,747,564 | A * | 5/1956 | Wehling | F01M 5/025 | 123/196 S |
| 2,867,203 | A * | 1/1959 | Easton | F01M 5/025 | 123/196 S |
| 2,889,821 | A * | 6/1959 | Maki | F01M 5/025 | 123/196 S |
| 3,425,404 | A * | 2/1969 | Lamkin | F01M 5/025 | 123/196 R |

(Continued)

FOREIGN PATENT DOCUMENTS

| | | |
|---|---|---|
| CN | 105275537 A | 1/2016 |
| DE | 212083 A1 | 8/1984 |

(Continued)

*Primary Examiner* — Kevin R Steckbauer

(74) *Attorney, Agent, or Firm* — Geoffrey Brumbaugh; McCoy Russell LLP

(57) ABSTRACT

Methods and systems are provided for an oil supply unit with a collecting vessel for collecting oil. In one example, a method may include maintaining a pressure of the collecting vessel during an engine off, wherein maintaining the pressure may further include maintain a temperature of the oil in the collecting vessel.

15 Claims, 5 Drawing Sheets

(56) References Cited

U.S. PATENT DOCUMENTS 3,583,525 A * 6/1971 Holcomb ..... F01M 5/025 184/6
3,583,527 A * 6/1971 Raichel ..... F01M 5/025 184/6
3,722,209 A * 3/1973 Kaytor ..... F01M 5/025 60/627
4,061,204 A * 12/1977 Kautz, Jr. ..... F01M 5/025 184/6.3
4,094,293 A * 6/1978 Evans ..... F01M 1/00 123/196 M
4,513,705 A * 4/1985 Evans ..... F01D 25/18 123/196 R
4,825,826 A * 5/1989 Andres ..... F01M 5/00 123/196 S
5,147,014 A * 9/1992 Pederson ..... F01M 5/025 123/196 S
5,197,424 A * 3/1993 Blum ..... F01M 5/025 123/196 S
5,244,059 A * 9/1993 McLaughlin ..... F01M 5/025 123/196 R
5,348,121 A * 9/1994 McLaughlin ..... F01M 5/025 123/196 R
5,460,097 A * 10/1995 Nekola ..... F01M 5/021 123/142.5 E
5,474,042 A * 12/1995 Kaneda ..... F01M 5/025 123/196 S
5,488,935 A * 2/1996 Berry, Jr. ..... F01M 5/025 123/196 S
5,494,012 A * 2/1996 Hagen ..... F01M 5/025 123/196 S
5,494,013 A * 2/1996 Helbig ..... F01M 5/025 123/196 S
5,589,059 A * 12/1996 Semar ..... B01D 29/055 210/109
5,655,495 A * 8/1997 Richards ..... F01M 5/025 123/196 M
5,694,896 A * 12/1997 Melvin ..... F01M 5/025 123/196 S
5,836,421 A * 11/1998 Leicht ..... F01M 5/025 184/6.2
6,148,789 A * 11/2000 Johns ..... F01M 5/025 123/196 R
6,460,500 B1 * 10/2002 Ooyama ..... F02N 7/00 123/179.3
6,561,155 B1 * 5/2003 Williams ..... F01M 1/02 123/196 AB
6,615,786 B2 * 9/2003 Mori ..... F02N 7/00 123/179.31
7,047,931 B2 * 5/2006 Sluka ..... F01L 1/344 123/196 R
7,331,323 B2 * 2/2008 Hara ..... F01L 1/46 123/196 A
8,015,810 B2 * 9/2011 Theobald ..... B60K 6/12 60/605.3
8,572,956 B2 * 11/2013 Miyabe ..... F16H 61/0031 60/417
9,097,336 B2 * 8/2015 Block ..... F15B 1/027
9,926,901 B2 * 3/2018 Burrahm ..... F02N 9/04
10,001,038 B2 * 6/2018 Will ..... F01M 5/021
2002/0166532 A1 * 11/2002 Mori ..... F02N 19/00 123/179.31
2005/0072397 A1 * 4/2005 Sluka ..... F16H 61/0031 123/198 C
2008/0283337 A1 * 11/2008 Theobald ..... F01M 5/025 184/6.1
2010/0236231 A1 * 9/2010 Miyabe ..... F16H 61/0031 60/413
2010/0311538 A1 * 12/2010 Miyabe ..... F16H 61/0031 477/2
2011/0214631 A1 * 9/2011 Sato ..... F02D 13/0226 123/90.1
2011/0220045 A1 * 9/2011 Sato ..... F01L 13/00 123/90.12
2013/0263948 A1 * 10/2013 Block ..... F15B 1/033 137/624.27
2013/0284289 A1 * 10/2013 Block ..... F15B 13/0431 137/544
2014/0138204 A1 5/2014 Danford
2014/0315687 A1 * 10/2014 Morino ..... B60W 10/02 477/181
2016/0010520 A1 * 1/2016 Will ..... F01M 5/021 123/196 AB
2017/0335815 A1 * 11/2017 Burrahm ..... F01M 1/02

FOREIGN PATENT DOCUMENTS

DE 3835561 A1 4/1990
DE 4135424 A1 4/1993
DE 10232319 A1 2/2004
DE 102009015450 A1 9/2010
DE 102011016558 A1 * 10/2012 ..... F16D 43/04
DE 102012200365 A1 7/2013
DE 102012109370 A1 * 4/2014 ..... F01M 5/025
DE 102012109370 A1 4/2014
DE 102015111159 A1 1/2016
EP 2455607 A2 5/2012
EP 2865881 A1 * 4/2015 ..... F02N 11/0814
EP 2455607 B1 * 11/2017 ..... F02N 19/005
GB 2461304 A 12/2009
GB 2466446 A 6/2010
JP 11013429 A * 1/1990 ..... F01L 1/34
WO 2009149772 A1 12/2009
WO 2009153070 A1 12/2009

* cited by examiner

OIL SUPPLY UNIT AND MOTOR VEHICLE

CROSS REFERENCE TO RELATED APPLICATION

The present application claims priority to German Patent Application No. 102016218835.6, filed Sep. 29, 2016. The entire contents of the above-referenced application are hereby incorporated by reference in its entirety for all purposes.

FIELD

The present description relates to an oil supply unit for a motor vehicle and also to a motor vehicle having this oil supply unit.

BACKGROUND/SUMMARY

In the prior art, a method for the oil supply of an internal combustion engine is known from DE 102009015450 A1, wherein an oil pump continuously supplies the operating internal combustion engine with oil. A pressurized quantity of oil from a tank temporarily supplies the internal combustion engine with oil when this is started. The oil pump can be operated in at least two stages in this case. The oil pump is operated at a low oil pressure in order to supply the operating internal combustion engine continuously with oil, and the oil pump is operated briefly at a high oil pressure in order to additionally store a pressurized quantity of oil in the tank while the internal combustion engine is in operation.

The present disclosure is based on the object of providing an improved oil supply unit and also a motor vehicle having this oil supply unit.

This object is achieved by means of an oil supply unit as claimed in claim 1 and also by means of a motor vehicle as claimed in claim 12. The oil supply unit according to the disclosure comprises a collecting vessel for collecting oil, a feed line which leads from the collecting vessel to an engine which is to be supplied with oil, a pump which is arranged in the feed line, a return line which leads from the engine to the collecting vessel, and a circulation line which leads from the feed line to the collecting vessel. According to the disclosure, the oil supply unit has a pressure accumulator which is connected via an accumulator line to the feed line and a two-way valve which can be switched in dependence of a pressure which prevails in the feed line. The two-way valve is in the first switched position in the case of a first pressure and is in the second switched position in the case of a second pressure which is higher than the first pressure. The circulation line is shut off in the first switched position of the two-way valve and opened in the second switched position of the two-way valve.

Therefore, an oil supply unit is provided in which the pressure accumulator acts with damping effect upon pressure fluctuations in the feed line. Moreover, by means of the pressure accumulator it is made possible to continue to supply the engine with oil even after a stoppage of the pump. Furthermore, by means of the pressure accumulator it is made possible to briefly provide a volumetric flow of oil which is greater than the possible volumetric flow which is to be delivered by the pump. Therefore, the pump can be of an altogether smaller design. This saves costs and weight.

The oil supply unit can be operated particularly efficiently since a changeover of the two-way valve into the second switched position brings about an unpressurized pumping through the circulation line which can be carried out with comparatively little energy.

The oil supply unit according to the disclosure offers a flexible construction and is consequently easily adaptable to the respective installation space situation.

In an embodiment of the oil supply unit according to the disclosure, the pump has a constant displacement capacity.

A fixed displacement pump may be less likely to degrade than a pump with variable displacement capacity. The pump can be designed so that this operates constantly within a favorable range with a high degree of efficiency.

In a further embodiment of the oil supply unit according to the disclosure, the two-way valve is a two/two-way valve which is arranged in the circulation line. Alternatively, the two-way valve is a three/two-way valve which is arranged in the feed line and to which is also connected the circulation line.

Therefore, provision is made for two simply constructed and robust embodiments which offer a long service life and high reliability.

In a further embodiment of the oil supply unit according to the disclosure, the pressure accumulator is provided with a thermal insulation.

In this way, it is made possible to keep heat energy contained in the stored for a longer period. The oil supply unit can therefore serve as a heat accumulator and serve for temperature control, especially for quicker warming up of the engine, which positively influences the durability of the engine.

In a further embodiment of the oil supply unit according to the disclosure, a two-way valve is arranged in the accumulator line, wherein the accumulator line is opened in a first switched position of the accumulator-line two-way valve and shut off in a second switched position of the accumulator-line two-way valve.

After a shutdown of the motor which drives the pump, the accumulator line, by setting the accumulator-line two-way valve into the second switched position, can be shut off and emptying of the pressure accumulator can be prevented. During a restart of the oil supply unit, pressure can then be built up more quickly. If the motor is the engine itself which is to be supplied, the engine can also already be supplied with oil before its startup by setting the accumulator-line two-way valve into the first switched position. This may improve the durability of the engine especially in the case of motor vehicles with a stop/start automatic unit.

In a further embodiment of the oil supply unit according to the disclosure, the pump can be driven by the engine and the pump is functionally connected to the engine via a clutch. In particular, the oil supply unit is designed in this case in a way that the clutch can be operated in dependence of an oil pressure of the oil supply unit. Alternatively, the pump can be driven by an electric motor which in particular can be controlled or switched.

In this way, it is made possible to switch off the pump when not desired during the operation of the oil supply unit. It is made possible to decouple the drive of the pump, for example when the pressure accumulator has been sufficiently filled. By switching on or switching off the pump, it is possible to maintain a pressure level which is as constant as possible. The efficiency of the oil supply unit is therefore further increased.

In a further embodiment of the oil supply unit according to the disclosure, an accumulator-line check valve, which shuts off the inflow to the pressure accumulator, and a bypass which circumvents the accumulator-line check valve and in which comprises a bypass restrictor, are arranged in the accumulator line.

As a result, the inflow to the pressure accumulator is limited and the supply to the engine desired. The flow from the pressure accumulator to the feed line can be carried out almost without hindrance in the process.

The oil supply unit according to the disclosure may be integrated into a motor vehicle. The motor vehicle according to the disclosure has an engine which can be supplied with oil from the oil supply unit.

Therefore, the oil supply unit described above may benefit to the motor vehicle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
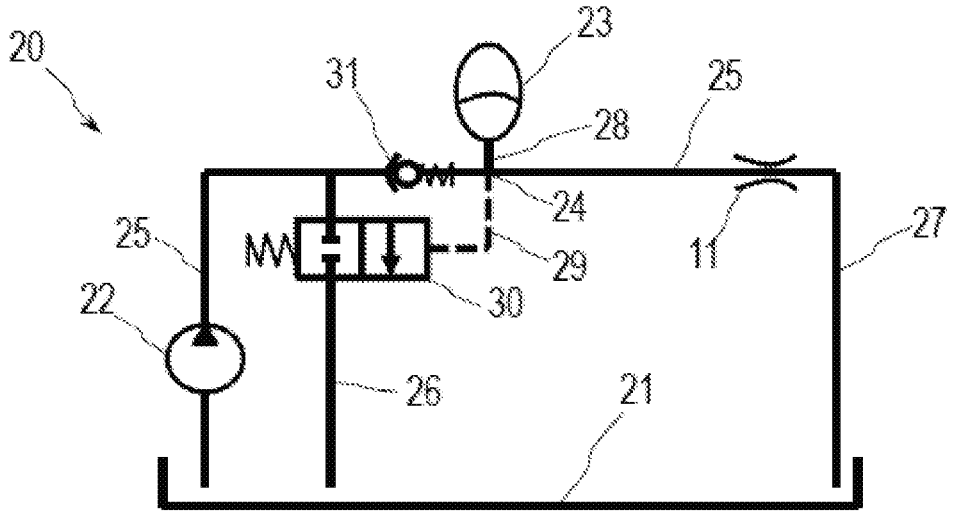
FIG. 1 shows an oil supply unit according to the disclosure in a first variant in an exemplary first embodiment.
Figure 2:
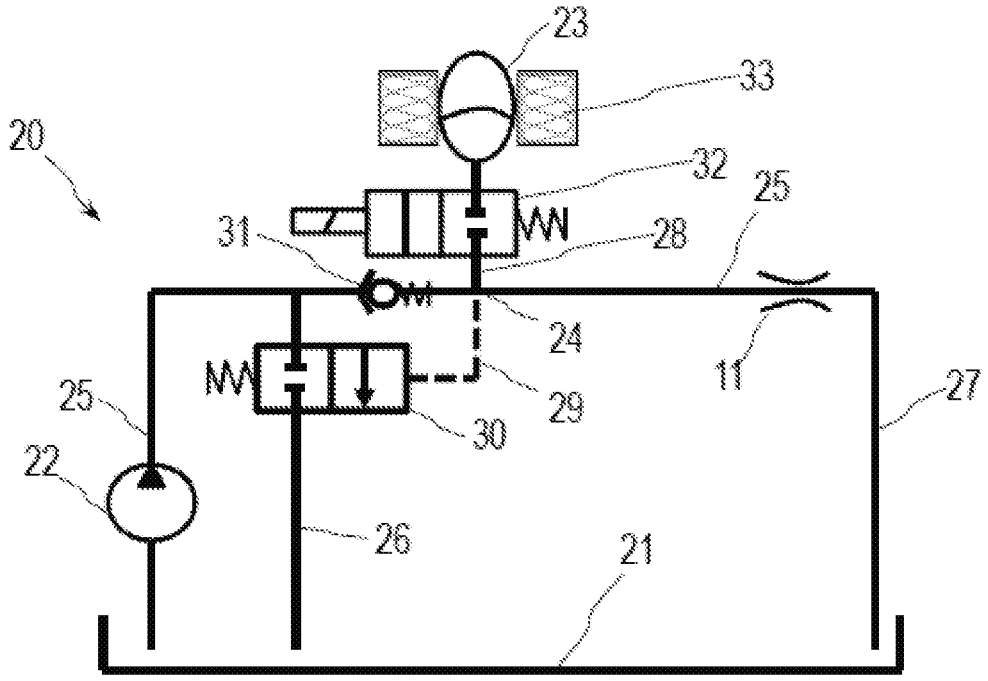
FIG. 2 shows the first variant of the oil supply unit in an exemplary second embodiment.
Figure 3:
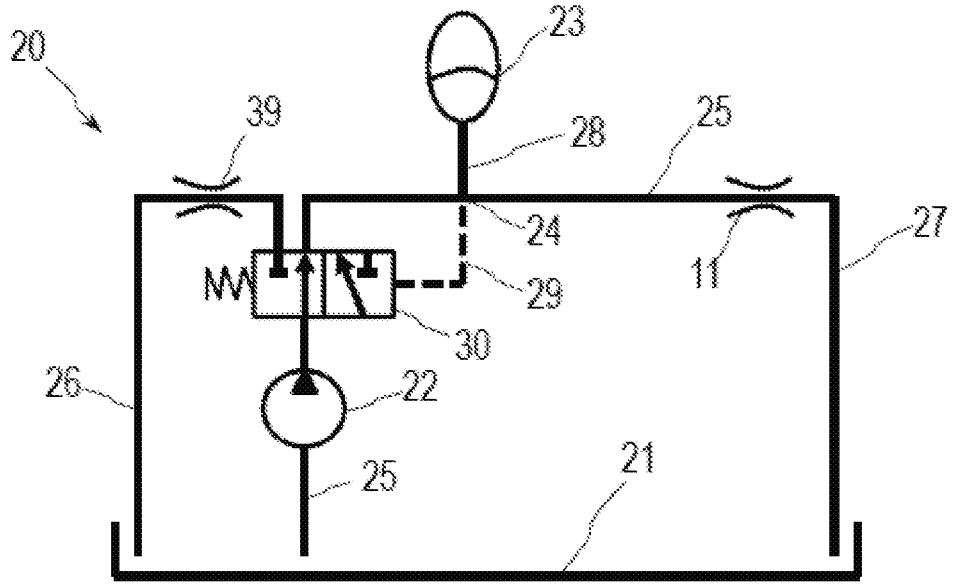
FIG. 3 shows the oil supply unit according to the disclosure in a second variant in an exemplary first embodiment.
Figure 4:
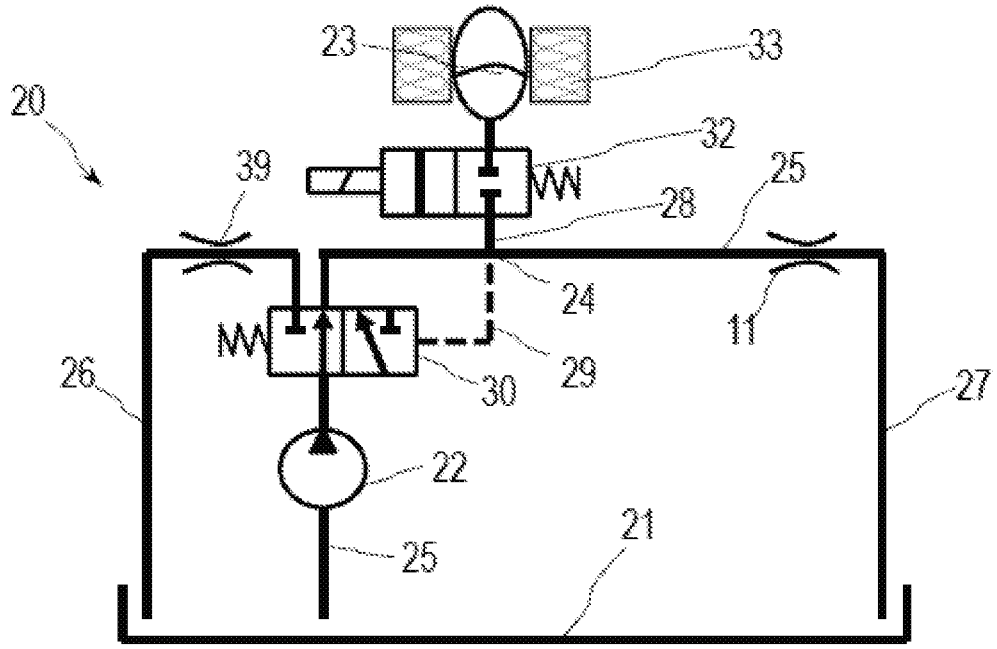
FIG. 4 shows the second variant of the oil supply unit in an exemplary second embodiment.
Figure 5:
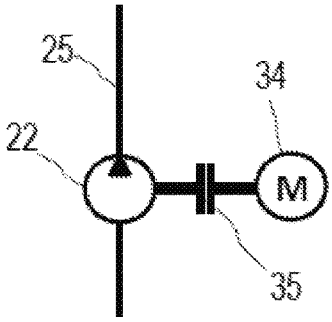
FIG. 5 shows an exemplary drive of the oil supply unit.
Figure 6:
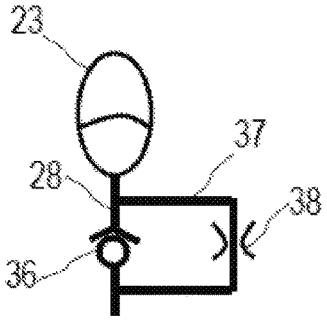
FIG. 6 shows a detailed section of the oil supply unit.
Figure 7:
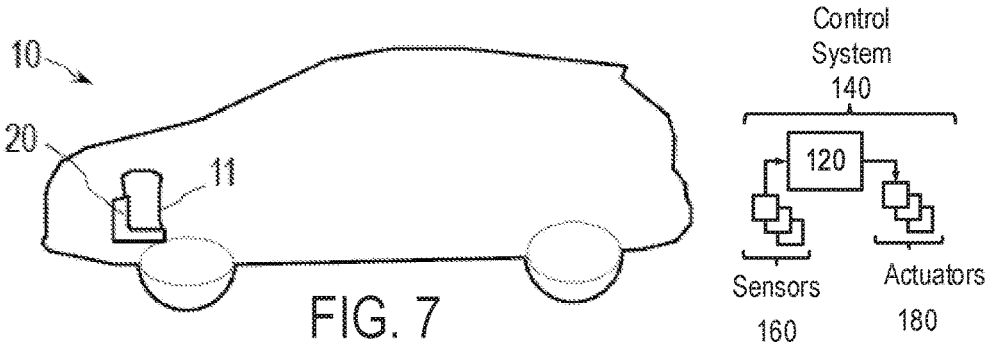
FIG. 7 shows a motor vehicle according to the disclosure in an exemplary embodiment.
Figure 8:
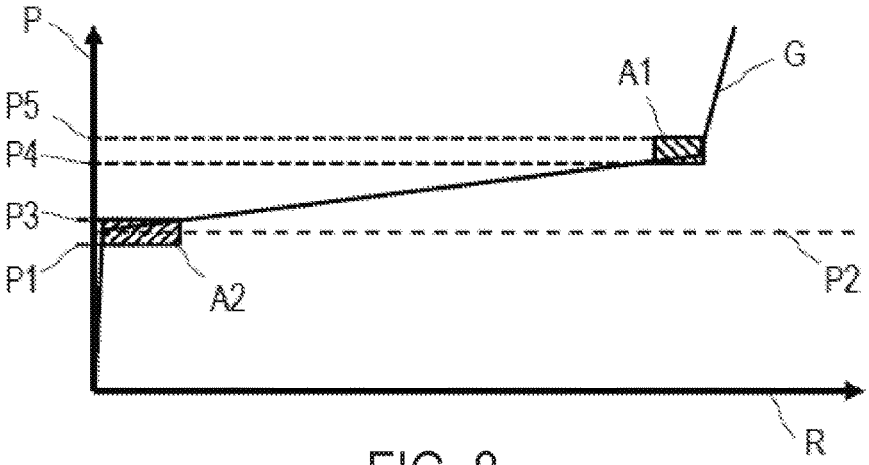
FIG. 8 shows an exemplary switching strategy of the oil supply unit.
Figure 9:
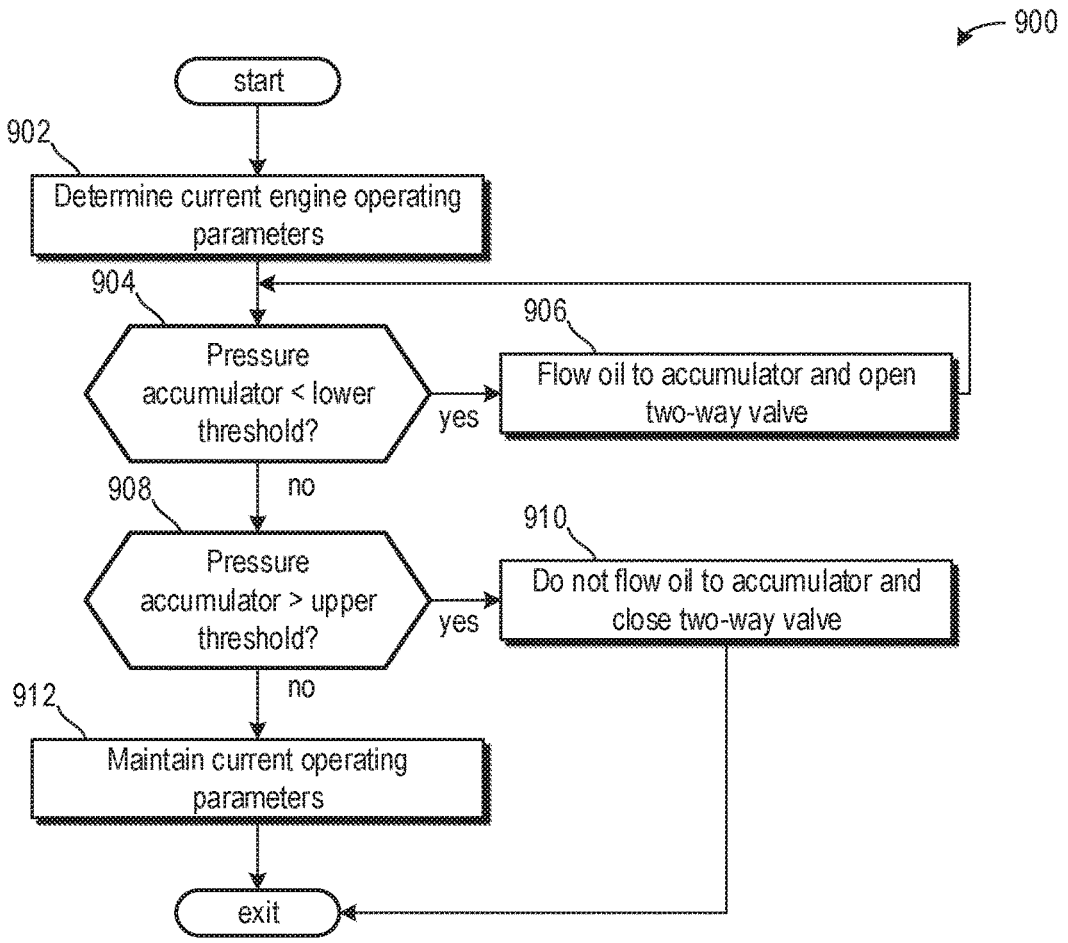
FIG. 9 shows a method for adjusting a valve of the oil supply circuit.
Figure 10:
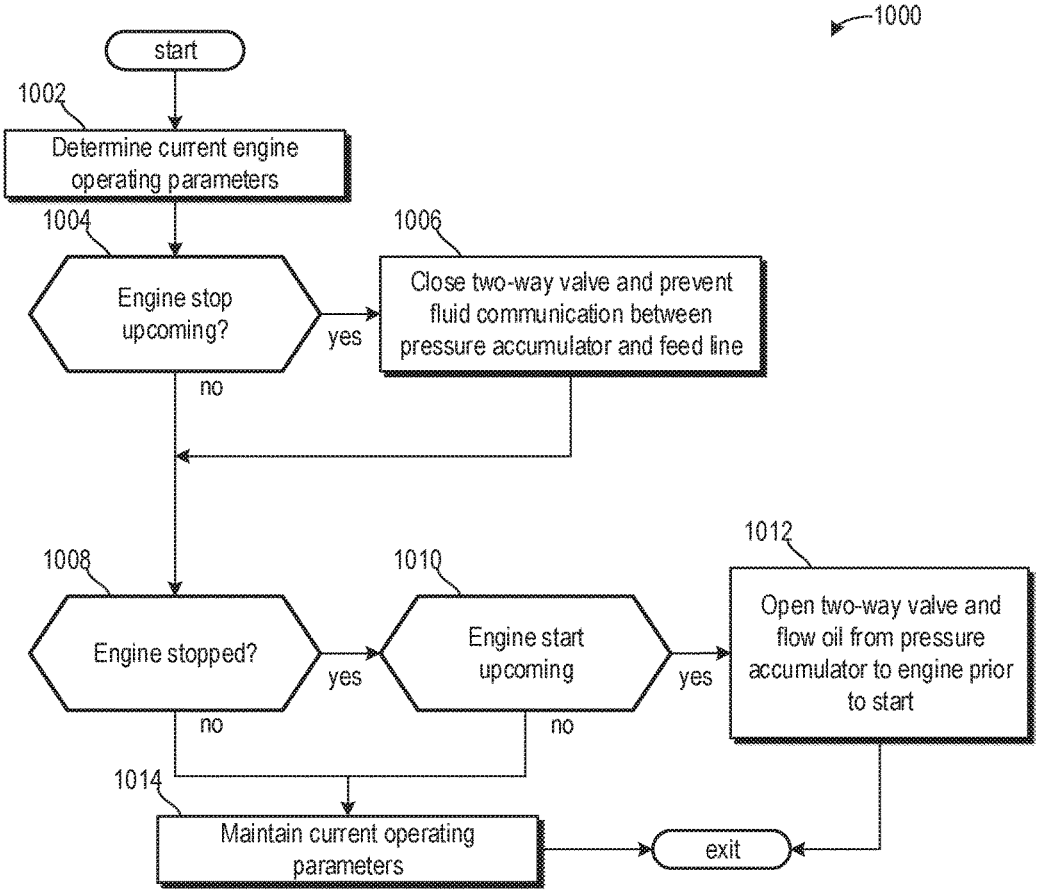
FIG. 10 shows a method for operating the pressure accumulator during an engine stop and/or cold-start.

The following description relates to systems and methods for an oil supply unit having a pressure accumulator. The pressure accumulator may supply oil to the engine during instances when an oil pump is off and/or when oil pressure is low. The oil supply unit is shown in FIG. 1. The oil supply unit is shown having a thermally insulating material in FIG. 2. The oil supply unit is shown coupled to high-pressure portion of a high and low pressure system in FIG. 3. The oil supply unit of FIG. 3 is shown having a thermally insulating material in FIG. 4. A motor may be optionally used to operate the pump of the oil supply unit, as shown in FIG. 5. A bypass passage to the pressure accumulator is shown in FIG. 6. A vehicle having an engine coupled to the oil supply unit and a control system is shown in FIG. 7. A graph depicting a switching strategy for a two-way valve coupling the pressure accumulator to a feed line is shown in FIG. 8. A method for adjusting the two-way valve for maintaining a pressure in the pressure accumulator is shown in FIG. 9. A method for using the pressure accumulator during an engine stop and/or cold-start is shown in FIG. 10.

Shown schematically in FIG. 7 is the motor vehicle 10 according to the disclosure in an exemplary embodiment. The motor vehicle 10 comprises an engine 11 which is to be supplied with oil. The engine 11 is particularly an internal combustion engine. According to the disclosure, the motor vehicle 10 comprises an oil supply unit 20 according to the disclosure which is designed to supply the engine 11 with oil, wherein oil is fed to the engine at a specified pressure.

The motor vehicle 10 may further include control system 140. Control system 140 is shown receiving information from a plurality of sensors 160 (various examples of which are described herein) and sending control signals to a plurality of actuators 180 (various examples of which are described herein). As one example, sensors 160 may include an exhaust gas sensor (located in an exhaust manifold), temperature sensor, intake manifold pressure transducer, and exhaust pressure transducer. Other sensors such as additional pressure, temperature, air/fuel ratio, and composition sensors may be coupled to various locations in the motor vehicle. As another example, the actuators may include fuel injectors, throttle, boost level output by turbocharger, etc. The control system 140 may include a controller 120. The controller may receive input data from the various sensors, process the input data, and trigger the actuators in response to the processed input data based on instruction or code programmed therein corresponding to one or more routines. One example routine is shown with reference to FIG. 9.

The controller 120 receives signals from the various sensors described above and employs the various actuators to adjust engine operation based on the received signals and instructions stored on a memory of the controller. For example, adjusting pressure accumulation of the oil supply unit may include adjusting an actuator of a two-way valve to adjust oil flow through an oil flow system.

In the sense of this disclosure oil may include all liquid lubricants.

The oil supply unit 20 according to the disclosure is shown schematically in FIGS. 1 to 4 in two different variants in two different exemplary embodiments in each case.

The oil supply unit comprises a collecting vessel 21, such as an oil sump, for storing and collecting the oil. The oil supply unit 20 furthermore comprises a feed line 25, a circulation line 26 and a return line 27.

The feed line 25 leads from the collecting vessel 21 to the engine 11. The feed line 25 is connected to the collecting vessel 21 and to the engine 11 with fluid conducting effect. The feed line 25 is designed to conduct oil from the collecting vessel 21 to the engine 11. Herein, fluid conducting effect may refer to a pressure relationship between two or more components, where fluid flows from a high pressure area to a low pressure area.

The circulation line 26 leads from the feed line 25 to the collecting vessel 21. The circulation line 26 is connected, or can be connected, to the feed line 25 with fluid conducting effect. The circulation line 26 is connected to the collecting vessel 21 with fluid conducting effect. The circulation line 26 is designed to conduct oil from the feed line 25 to the collecting vessel 21.

The return line 27 leads from the engine 11 to the collecting vessel 21. The return line 27 is connected to the engine and to the collecting vessel 21 with fluid conducting effect. The return line 27 is designed to conduct oil from the engine 11 to the collecting vessel 21.

The oil supply unit is provided with a pump 22 which is arranged in the feed line 25. The pump 22 may be a fixed displacement pump and therefore has a constant displacement capability. The pump 22 can be driven by a motor 34, shown in FIG. 5. An actuator of the motor 34 may be electrically coupled to a controller (e.g., controller 120 of FIG. 1). The pump 22 may not be permanently driven during the operation of the oil supply unit 20. To this end, the drive can comprise an electric motor which can be controlled or at least switched. The electric motor can therefore be operated when desired. Alternatively, the pump 22 can be driven by means of a motor 34 which operates permanently during the operation of the oil supply unit 20. The pump 22 in this case can be connected to the motor 34 via a clutch 35 when desired. The clutch 35 maybe operated in dependence of an oil pressure of the oil supply unit 20. The engine 11 is the motor 34, in one example.

The oil supply unit 20 has, according to the disclosure, a pressure accumulator 23 and an accumulator line 28. The accumulator line 28 is arranged between the pressure accumulator 23 and the feed line 25. The accumulator line 28 is connected to the pressure accumulator 23 with fluid conducting effect. The accumulator line 28 is connected to the feed line 25 with fluid conducting effect at a connection point 24. The accumulator line 28 is designed to conduct oil from the feed line 25 to the pressure accumulator 23 and also from the pressure accumulator 23 to the feed line 25. The pressure accumulator 23 is especially preloaded to a specified system pressure. The pressure accumulator 23 is especially designed as a piston accumulator with a pressure chamber and a rearward open chamber so that the filling degree of the pressure accumulator does not in essence influence an oil filling level. The rearward chamber is connected in this case to the collecting vessel 21 with fluid conducting effect. The pressure accumulator 23 can also be provided with a thermal insulation 33 (as shown in FIG. 2). The thermal insulation 33 may comprise a gap arranged around the pressure accumulator 23 or a thermally insulating material (e.g., rubber, cloth, and the like). For example, the pressure accumulator 23 may comprise a double walled outer shell with one or more of air and water arranged therebetween. The air and/or water may act as a thermal barriers between contents arranged interior to the pressure accumulator 23 and a thermal environment outside of the pressure accumulator 23. Additionally or alternatively, a vacuum may be arranged between the walls of the double walled outer shell.

Moreover, the oil supply unit 20 can have an accumulator-line check valve 36, a bypass 37 and a bypass restrictor 38. The accumulator-line check valve 36 is in this case arranged in the accumulator line 28 in a way that an inflow to the pressure accumulator 23 through the accumulator line 28 is shut off. The inflow to the pressure accumulator 23 is enabled in this case by means of the bypass 37 which is arranged to circumvent the accumulator-line check valve 36. The bypass restrictor 38, which restricts the inflow to the pressure accumulator 23, can be arranged in the bypass 37.

The oil supply unit 20 also comprises, according to the disclosure, a two-way valve 30 which can be selectively switched into two switched positions. The two-way valve 30 is especially connected to a control line 29 which picks up the pressure in the feed line 25. The two-way valve 30 can be switched in dependence of the pressure which prevails in the feed line 25. Therefore, the two-way valve 30 has a first switched position in the case of a first pressure in the feed line 25 and has a second switched position in the case of a second pressure. The first pressure in this case is lower than the second pressure. In the first switched position, the circulation line 26 is shut off so that no oil can make its way from the feed line 25 via the circulation line 26 to the collecting vessel. In the second switched position, the circulation line 26 is opened so that oil can make its way from the feed line 25 via the circulation line 26 to the collecting vessel.

The present disclosure provides two variants of the oil supply unit 20. The first variant is shown in FIGS. 1 and 2 and the second variant is shown in FIGS. 3 and 4.

In the first variant, the two-way valve 30 is arranged in the circulation line 26 and is designed as a two/two-way valve, that is to say with two connection points. The circulation line 26 is connected to both connection points. In the first switched position, both connection points are blocked in this case. A flow through the two-way valve is prevented. The first switched position is shown in FIGS. 1 and 2. In the second switched position, both connection points are interconnected in this case. A flow through the second switch position of the two-way valve 30 is enabled.

Between the point at which the circulation line 26 branches from the feed line 25 and the connection point 24 at which the accumulator line 28 leads into the feed line 25, a check valve 31 is arranged in the feed line 25 in the first variant in order to prevent oil being able to make its way from the pressure accumulator 23 through the circulation line 26 to the collecting vessel 21. The check valve 31 can be designed with or without a spring.

In the second variant, the two-way valve 30 is arranged in the feed line 25 and is designed as a three/two-way valve, that is to say with three connection points. The circulation line 26 is connected to a first of the three connection points. The feed line 25 is connected to a second and a third of the three connection points. In the first switched position, the first connection point is blocked in this case and a connection is made between the second and third connection points. A flow through the three/two-way valve from a portion of the feed line 25 upstream of the pump 22 to a portion of the feed line 25 leading to the engine 11 is enabled. The circulation line 26 is connected to the feed line 25 in the first switched position with no fluid-conducting effect in this case. Said another way, in the first switched position, the first of the three connection points is closed, thereby reducing and/or preventing fluid flow from the circulation line to the feed line 25. The first switched position is shown in FIGS. 3 and 4. In the second switched position, the first and the second connection points are interconnected with fluid-conducting effect in this case. A flow through the three/two-way valve from the portion of the feed line 25 upstream of the pump 22 to the circulation line 26 is enabled. The portion of the feed line 25 leading to the engine 11 is connected to the pump-side feed line 25 in the second switched position with no fluid-conducting effect in this case. Said another way, when the three/two-way valve is in the second switched position, fluid may not flow from the pump 22 to the engine 11.

The circulation line 26 can be in communication with a low-pressure system 39. It is in the manner shown in FIGS. 3 and 4. If the two-way valve 30 is in the second switched position, then the pump 22 performs work for the low-pressure system 39. The low-pressure system 39 is for example a tank system.

As an option, the oil supply unit 20 can have an accumulator-line two-way valve 32 in both variants. It is in the manner shown in FIGS. 2 and 4. The accumulator-line two-way valve 32 is a two/two-way valve with two connection points and two switched positions. The accumulator line 28 is connected to both connection points. In a first switched position, a flow through the accumulator-line two-way valve 32 is enabled and the accumulator line 28 is opened.

In a second switched position, flow is prevented and the accumulator line 28 is shut off. The second switched position is shown in FIGS. 2 and 4. In one example, when the two-way valve 32 is in the first switched position, the accumulator line 28 flows fluid from the pressure accumulator 23 to the feed line 25. Thus, when the two-way valve 32 is in the second switched position, the accumulator line 28 flows less or prevents fluid flow from the pressure accumulator 23 to the feed line 25.

Shown in FIG. 8 is an exemplary switching strategy for the two-way valve 30. In this case, the pressure P inside the pressure accumulator 23 is mapped against a filling level R of the pressure accumulator. Based on the two-way valve 30 being in the first switched position, the pressure P rises in the pressure accumulator 23 up to a preload pressure P2, while the pump 22 is in operation and has an output volume which is greater than that demanded by the engine 11—see graph G. From the preload pressure P2 onward, the pressure P rises corresponding to a spring characteristic of a preload device of the pressure accumulator 23 which exerts the preload. Progressing further, the pressure P rises in proportion to the filling level R up to the point at which the pressure accumulator 23 is completely filled. At this point, between a fourth pressure P4 and a fifth pressure P5, the first switching range A1 is formed. In the first switching range A1, the two-way valve 30 is switched from the first switched position into the second switched position. Supplying the engine 11 with oil now takes place with the oil stored in the pressure accumulator 23, wherein the pressure P in the pressure accumulator 23 falls again and the filling level R decreases. Between a first pressure P1 and a third pressure P3, a second switching range A2 is formed. The preload pressure P2 lies between the first pressure P1 and the third pressure P3. In the second switching range A2, the two-way valve 30 is switched from the second switched position into the first switched position. Supplying the engine 11 with oil now takes place with the oil which is delivered by the pump 22, wherein the pressure P in the pressure accumulator 23 rises again and the filling level R increases.

Controlling of the valves 30, 32, of the clutch 35 and/or of the motor 34 can be carried out by means of a control unit to which pressure signals of the oil supply unit 20 are made available.

Turning now to FIG. 9, it shows a method 900 for adjusting oil flow to and from the pressure accumulator. Instructions for carrying out method 900 and the rest of the methods included herein may be executed by a controller based on instructions stored on a memory of the controller and in conjunction with signals received from sensors of the engine system, such as the sensors described above with reference to FIG. 7. The controller may employ engine actuators of the engine system to adjust engine operation, according to the methods described below.

The method 900 begins at 902 where the method includes determining, estimating, and measuring engine operating parameters. Engine operating parameters may include but are not limited to one or more of manifold pressure, throttle position, engine speed, vehicle speed, exhaust gas recirculation flow rate, engine temperature, and air/fuel ratio.

At 904, the method 900 may include determining if a pressure of the pressure accumulator is less than a lower threshold. In one example, the lower threshold is a non-zero value. The lower threshold may be based on a pressure of the pressure accumulator where the pressure accumulator is unable to flow lubricant to the engine when the pump is off. Additionally or alternatively, the lower threshold is substantially equal to the pressure value of preload pressure P2 of FIG. 8. In one example, the lower threshold pressure corresponds to a pressure accumulator being 20 to 30% full of oil.

If the pressure of the pressure accumulator is less than the lower threshold, then the method 900 proceeds to 906 to flow oil to the accumulator. This may include opening the two-way valve in the circulation line (e.g., two-way valve 30 in circulation line 26 of FIGS. 1 and 2). Additionally or alternatively, an accumulator line two-way valve (e.g., accumulator line two-way valve 32 of FIGS. 2 and 4) may be opened. By opening these two-way valves, the pressure accumulator may be fluidly coupled to portions of the oil supply unit. The method continues to monitor the pressure of the pressure accumulator. When the pressure of the pressure accumulator is less than the lower threshold, the pump (e.g., pump 22 of FIG. 2) is the sole provider of oil to the engine. Said another way, the pressure accumulator may not provide oil to the engine when its pressure is less than the lower threshold.

If the pressure of the pressure accumulator is greater than the lower threshold, then the method 900 proceeds to 908 to determine if the pressure of the pressure accumulator is greater than an upper threshold. In one example, the upper threshold is equal to a non-zero value. Specifically, the upper threshold may be equal to a pressure between the fourth pressure P4 and the fifth pressure P5 of FIG. 8. Additionally or alternatively, the upper threshold may be equal to a pressure corresponding to a pressure accumulator being 80-90% full of lubricant (e.g., oil).

If the pressure of the pressure accumulator is greater than the upper threshold, then the method 900 may proceed to 910 to not flow oil to the accumulator. This may additionally include closing one or more of the two-way valves arranged in the accumulator line and the circulation line (e.g., two-way valves 32 and 30, respectively, of FIG. 2). As such, the pressure accumulator is sufficiently full of lubricant and is at a desired pressure. By closing the two-way valves, the pressure accumulator may not fluidly communicate with the oil supply unit. However, if only the two-way valve in the circulation line is closed and the two-way valve in the accumulator line is at least partially open, then the pressure accumulator may fluidly communicate with the engine (e.g., engine 11 of FIG. 2). Fluidly communicate may be defined as fluid transfer between two or more components. In one example, when the pressure of the pressure accumulator is greater than the upper threshold, only the pressure accumulator flows lubricant to the engine. As such, the pump may not flow lubricant to the engine when the pressure of the pressure accumulator is greater than the upper threshold.

In some examples, additionally or alternatively, when the pressure of the pressure accumulator is greater than at least the lower threshold (e.g., may be greater than or less than the upper threshold), then the pressure accumulator and/or the pump may flow lubricant to the engine. In some example, the pump and the pressure accumulator may alternate in flowing lubricant to the engine. Additionally or alternatively, the pump and the pressure accumulator may work in tandem to flow lubricant to the engine. In one example, the accumulator line two-way valve may be adjusted between open and closed positions to adjust an amount of assistance provided by the pressure accumulator to the pump. Positions between the open and closed positions may be referred to as more open and more closed positions, where more open position allow more lubricant to flow from the pressure accumulator to the feed line than the more closed positions. As such, if a greater amount of assistance from the pressure accumulator is desired, then the accumulator line two-way valve may be move to a more open position or fully open position. In this way, the pump may be forced to provide less lubricant to the engine, thereby decreasing work done by the pump, and increasing fuel economy. This may be desired during higher engine loads when the pump is driven by the engine. By utilizing the pressure accumulator, more power output from the engine may be directed toward the wheels to meet a driver demand.

If the pressure in the pressure accumulator is less than the upper threshold and greater than the lower threshold, then the method 900 may proceed to 912 to maintain current engine operating parameters. When the pressure in the pressure accumulator is between the upper and lower threshold, the pressure accumulator may still be configured to flow oil to the engine. In this way, the pump and the pressure accumulator may alternate in feeding oil to the engine.

Turning now to FIG. 10, it shows a method 1000 for maintain pressure in the pressure accumulator in response to an upcoming engine stop and flowing lubricant to the engine in response to an upcoming engine start.

The method 1000 begins at 1002 where the method includes determining, estimating, and/or measuring current engine operating parameters. Engine operating parameters may include but are not limited to one or more of manifold pressure, throttle position, engine speed, vehicle speed, exhaust gas recirculation flow rate, engine temperature, engine on or off, and air/fuel ratio.

At 1004, the method 1000 may include determining if an engine stop is upcoming. An engine stop may be upcoming if one or more of an accelerator pedal is released (e.g., inclined) and a brake pedal is depressed (e.g., declined). The engine stop may include the engine cylinders no longer combusting. Additionally or alternatively, the engine stop may include an engine off, where the engine is no longer fueled and stops spinning.

Additionally or alternatively, the upcoming engine stop may be determined via a navigation system. For example, the navigation system may determine that the vehicle is approaching a stop light and an engine stop of a start/stop procedure. Furthermore, the navigation system may determine the destination of a route being reached (e.g., "home", "work", or the like).

At 1006, the method 1000 may include preventing fluid communication between the pressure accumulator and the feed line. This may include closing the two-way valve in the circulation line and/or the two-way valve in the accumulator line. As such, the pressure in the pressure accumulator may be maintained when the engine stop occurs. As described above, the engine may function as the motor operating the pump. In this way, if the engine stops, then the pump may no longer deliver lubricant to the engine. Thus, upon an engine restart, lubricant flow to the engine may lag, resulting in insufficiently lubricated engine components. However, this may be prevented by maintaining the pressure of the pressure accumulator when the engine is stopped so that when an engine restart is upcoming the pressure accumulator may prematurely flow lubricant to the engine.

Additionally, since the pressure accumulator may be thermally insulated, a temperature of the lubricant in the pressure accumulator may be maintained such that hot lubricant from when the engine was previously operating may flow to engine upon a subsequent restart. This may reduce a cold-start duration, thereby decreasing cold-start emissions.

If the engine stop is not upcoming, then the method 1000 may proceed to 1008 to determine if the engine is stopped. The engine is stopped if the engine is one or more of not being fueled and not spinning.

If the engine is stopped, then the method 1000 may proceed to 1010 to determine if an engine start is upcoming. An engine start may be upcoming if the brake pedal is released (e.g., inclined) and/or if the accelerator pedal is depressed (e.g., declined). Additionally or alternatively, the engine start may be upcoming if a key is inserted into an ignition or if an ignition button is depressed. Furthermore, the engine start may be upcoming if a user enters the driver's portion of the car and sits in the driver's seat. Still further, the upcoming engine start may be determined by a navigation system monitoring a traffic light changing from stop to go or determining a time of day that a user generally begins using the car. For example, if a user begins driving at 7:00 am on average daily, then the navigation system may determine the engine start is upcoming at 6:59 am.

If the engine start is upcoming, then the method 1000 may proceed to 1012 to flow lubricant from the pressure accumulator to the engine prior to the engine start. In one example, prior to the engine start may be based on a threshold time (e.g., 15 seconds) before the start. The threshold time may be based on an amount of time needed for the pressure accumulator to sufficiently lubricate the engine. Additionally or alternatively, the threshold time before the engine start may be adjusted based on a pressure of the pressure accumulator, where the threshold time decreases as the pressure of the pressure accumulator increases. For example, the threshold time corresponding to a pressure equal to the fifth pressure P5 is less than the threshold time corresponding to a pressure less than the third pressure P3. This may be due to a higher lubricant flow rate of a pressure accumulator having a higher pressure compared to a lower pressure. To flow the lubricant from the pressure accumulator to the engine, one or more of the two-way valve in the accumulator line is opened and the two-way valve in the circulation line is opened. In one example, only the accumulator line two-way valve is opened and the two-way valve in the circulation line remains closed. Due to the thermal insulation of the pressure accumulator, a temperature of the lubricant flowing from the pressure accumulator to the engine prior to the upcoming engine start is hotter than an engine temperature. By doing this, the engine may be warmed-up to a temperature closer to a desired operating temperature.

Returning to 1008 and 1010, if the engine is not stopped or the engine start is not upcoming, respectively, then the method 1000 proceeds to 1014 to maintain current engine operating parameters. In one example, the method 900 of FIG. 9 is followed.

In this way, a pressure accumulator is configured to maintain a desired pressure range. The technical effect of maintain the desired pressure range is to allow the pressure accumulator to flow lubricant to the engine during engine off conditions or during conditions where it would be desired to shut-off the pump. Additionally, by thermally insulating the pressure accumulator, the pressure accumulator may deliver hot lubricant to the engine during engine off conditions when hot lubricant is otherwise unavailable.

An embodiment of an oil supply unit comprises a collecting vessel for collecting oil, a feed line which leads from the collecting vessel to an engine which is to be supplied with oil, a pump which is arranged in the feed line, a return line which leads from the engine to the collecting vessel, and a circulation line which leads from the feed line to the collecting vessel, further comprising a pressure accumulator which is connected via an accumulator line to the feed line, the pressure accumulator being thermally insulated and a two-way valve which can be switched in dependence of a pressure which prevails in the feed line, wherein the two-way valve is in a first switched position in the case of a first pressure and is in a second switched position in the case of a second pressure which is higher than the first pressure, wherein the circulation line is shut off in the first switched position of the two-way valve and is opened in the second switched position of the two-way valve. A first example of the oil supply unit further comprises where a pump has a constant displacement capacity. A second example of the oil supply unit, optionally including the first example, further includes where the two-way valve is a two/two-way valve which is arranged in the circulation line. A third example of the oil supply unit, optionally including the first and/or second examples, further includes where the two-way valve is a three/two-way valve which is arranged in the feed line and to which is connected the circulation line. A fourth example of the oil supply unit, optionally including one or more of the first through third examples, further includes where the accumulator line comprises an accumulator line two-way valve, wherein the accumulator line is fluidly coupled to the feed line in a first switched position of the accumulator-line two-way valve and fluidly sealed from the feed line in a second switched position of the accumulator-line two-way valve. A fifth example of the oil supply unit, optionally including one or more of the first through fourth examples, further includes where the pump is driven by the engine and the pump is functionally connected to the engine via a clutch, and where the clutch is operated in dependence of an oil pressure of the oil supply unit. A sixth example of the oil supply unit, optionally including one or more of the first through fifth examples, further includes where the pump is driven by an electric motor, the electric motor configured to be adjusted via a controller comprising computer-readable instructions stored on memory thereon that when executed enable the controller to switch the electric motor between on and off positions based on an oil pressure of the oil supply unit. A seventh example of the oil supply unit, optionally including one or more of the first through sixth examples, further includes where the accumulator line further comprises an accumulator-line check valve configured to shut off an inflow to the pressure accumulator, and a bypass configured to circumvent the accumulator-line check valve via a bypass restrictor.

An embodiment of a system comprises a collecting vessel for storing lubricant being fluidly coupled to a feed line and a circulation line, a pump and an engine being arranged along the feed line, an accumulator line fluidly coupled to both the feed and circulation lines, and a pressure accumulator arranged along the accumulator line, the pressure accumulator configured to store lubricant at a pressure independent of a pressure of the feed line, and where the pressure accumulator comprises thermal insulation. A first example of the system further includes where the thermal insulation is an insulating material comprising one or more of rubber, ceramic, and metal. A second example of the system, optionally including the first example, further includes where the circulation line fluidly couples the pressure accumulator to the collecting vessel, and where the circulation line comprises a two-way valve configured to fluidly couple and fluidly seal the pressure accumulator from the collecting vessel. A third example of the system, optionally including the first and/or second examples further includes where the pressure accumulator receives lubricant when a pressure of the pressure accumulator is less than a lower threshold and where the pressure accumulator does not receive lubricant when the pressure of the pressure accumulator is greater than an upper threshold, where the upper threshold is equal to a pressure greater than a pressure equal to the lower threshold. A fourth example of the system, optionally including one or more of the first through third examples, further includes where the pressure accumulator flows lubricant to the engine when the pressure of the pressure accumulator is greater than the lower threshold. A fifth example of the system, optionally including one or more of the first through fourth examples, further includes where the accumulator comprises an accumulator line two-way valve, the accumulator line two-way valve configured to fluidly couple and fluidly seal the pressure accumulator from the feed line. A sixth example of the system, optionally including one or more of the first through fifth examples, further includes where comprising a controller with computer-readable instruction stored thereon that when executed enable the controller to close the accumulator line two-way valve in response to an upcoming engine stop, and open the accumulator line two-way valve in response to an upcoming engine start.

An embodiment of a method comprises flowing lubricant from a lubricant supply unit to a pressure accumulator, the pressure accumulator comprising a thermal insulation and maintaining a pressure of the lubricant in the pressure accumulator during an engine off. A first example of the method further includes where maintaining the pressure of the lubricant in the pressure accumulator further comprises adjusting a two-way valve to a closed position to fluidly seal the pressure accumulator from the lubricant supply unit in response to an upcoming engine off, where the upcoming engine off prior to the engine off by a threshold time. A second example of the method, optionally including the first example, further includes where adjusting the two-way valve to an open position during the engine off and prior to an engine start to prematurely flow lubricant from the pressure accumulator to an engine, where the open position fluidly couples the pressure accumulator to the lubricant supply unit. A third example of the method, optionally including the first and/or second examples, further includes where the flowing occurs in response to a pressure of the pressure accumulator being less than a lower threshold, where the lower threshold is based on a fill of the pressure accumulator. A fourth example of the method, optionally including one or more of the first through third examples, further includes where the lubricant supply unit comprises a pump, and where the pump and the pressure accumulator are configured to flow lubricant to an engine arranged along the feed line.

Although the disclosure has been fully illustrated and described in detail by means of the exemplary embodiments, the disclosure is not limited by the disclosed examples and other variations can be derived by the person skilled in the art without departing from the extent of protection of the disclosure.

The figures are not necessarily true to detail and true to scale and can be represented in an enlarged or downsized form in order to provide a better overview. Therefore, in this case, disclosed functional details are not to be understood as being limiting but only as a descriptive basis which offers the person skilled in the art guidance in this field of technology in order to use the present disclosure in a diverse manner.

The expression "and/or" used here, if it is used in a number of two or more elements, means that each of the described elements can be used alone or each combination of two or more of the described elements can be used. If for example a composition is described, wherein it contains the components A, B and/or C, the composition can contain A alone; B alone; C alone; A and B in combination; A and C in combination; B and C in combination; or A, B and C in combination.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-3, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An oil supply unit comprising:

a collecting vessel for collecting oil, a feed line which leads from the collecting vessel to an engine which is to be supplied with oil, a pump which is arranged in the feed line, a return line which leads from the engine to the collecting vessel, a circulation line comprising a first two-way valve, which leads from the feed line to the collecting vessel, and a control line connecting the feed line and the first two-way valve, further comprising a pressure accumulator which is connected via an accumulator line to the feed line;

wherein the first two-way valve which can be switched in dependence of a pressure which prevails in the feed line, wherein the first two-way valve is in a first switched position in the case of a first pressure and is in a second switched position in the case of a second pressure which is higher than the first pressure, wherein the circulation line is shut off in the first switched position of the first two-way valve and is opened in the second switched position of the first two-way valve;

a second two-way valve coupled to the accumulator line; and a controller storing instructions in non-transitory memory that, when executed, cause the controller to:

in response to an engine-off condition, close the second two-way valve, and in response to an upcoming engine start, open the second valve a threshold time prior to the upcoming engine start and close the first valve to flow lubricant from the pressure accumulator to the engine, the threshold time adjusted based on a pressure of the pressure accumulator, wherein a temperature of the lubricant flowing from the pressure accumulator to the engine is hotter than an engine temperature.

2. The oil supply unit of claim 1, wherein the pump has a constant displacement capacity and where the pressure accumulator is thermally insulated.

3. The oil supply unit of claim 2, wherein the pressure accumulator is thermally insulated via a combination of air and water.

4. The oil supply unit of claim 1, wherein the accumulator line is fluidly coupled to the feed line in the first switched position of the second two-way valve and fluidly sealed from the feed line in the second switched position of the second two-way valve.

5. The oil supply unit of claim 1, wherein the pump is driven by the engine and the pump is functionally connected to the engine via a clutch, and where the clutch is operated in dependence of an oil pressure of the oil supply unit.

6. The oil supply unit of claim 1, wherein the pump is driven by an electric motor, the electric motor configured to be adjusted via the controller comprising computer-readable instructions stored on memory thereon that when executed cause the controller to switch the electric motor between on and off positions based on an oil pressure of the oil supply unit.

7. The oil supply unit of claim 1, wherein the accumulator line further comprises an accumulator-line check valve configured to shut off an inflow to the pressure accumulator, and a bypass configured to circumvent the accumulator-line check valve via a bypass restrictor.

8. A system comprising:

a collecting vessel for storing lubricant being fluidly coupled to a feed line and a circulation line, a pump and an engine being arranged along the feed line, wherein the circulation line comprises a first valve;

an accumulator line fluidly coupled to both the feed and circulation lines, the accumulator line comprising a second valve;

a pressure accumulator arranged along the accumulator line, the pressure accumulator configured to store lubricant at a pressure independent of a pressure of the feed line, and where the pressure accumulator comprises thermal insulation; and a controller storing instructions in non-transitory memory that, when executed, cause the controller to:

in response to an engine-off condition, close the second valve to maintain a temperature of the lubricant, and in response to an upcoming engine start, open the second valve a threshold time prior to the upcoming engine start and close the first valve to flow hot lubricant from the pressure accumulator to the engine, the threshold time decreasing with an increase in a pressure of the pressure accumulator.

9. The system of claim 8, wherein the thermal insulation is an insulating material comprising one or more of rubber, ceramic, and metal.

10. The system of claim 8, wherein the circulation line fluidly couples the pressure accumulator to the collecting vessel, and where the first valve is a two-way valve configured to fluidly couple and fluidly seal the pressure accumulator from the collecting vessel.

11. The system of claim 8, wherein the pressure accumulator receives lubricant when the pressure of the pressure accumulator is less than a lower threshold and where the pressure accumulator does not receive lubricant when the pressure of the pressure accumulator is greater than an upper threshold, where the upper threshold is equal to a pressure greater than a pressure equal to the lower threshold.

12. The system of claim 11, wherein the pressure accumulator flows lubricant to the engine when the pressure of the pressure accumulator is greater than the lower threshold.

13. The system of claim 8, wherein the second valve is configured to fluidly couple and fluidly seal the pressure accumulator from the feed line.

14. A method comprising:

flowing lubricant from a pump to a pressure accumulator through a feed line, the pressure accumulator comprising a thermal insulation; and maintaining a pressure of the lubricant in the pressure accumulator during an engine off;

wherein maintaining the pressure of the lubricant in the pressure accumulator further comprises adjusting a second two-way valve in an accumulator line to a closed position to fluidly seal the pressure accumulator from the feed line in response to an upcoming engine off, where the upcoming engine off is prior to the engine off by a threshold time; and in response to an upcoming engine start, opening the second two-way valve another threshold time prior to the upcoming engine start while maintaining a first two-way valve coupled to the circulation line closed to flow hot lubricant from the pressure accumulator directly to the engine, the another threshold time adjusted based on a pressure of the pressure accumulator.

15. The method of claim 14, wherein the flowing lubricant from the pump to the pressure accumulator occurs in response to a pressure of the pressure accumulator being less than a lower threshold, where the lower threshold is based on a fill of the pressure accumulator.

* * * * *